US007331644B2

(12) United States Patent
Lowe

(10) Patent No.: US 7,331,644 B2
(45) Date of Patent: Feb. 19, 2008

(54) STAY-CLOSED DRAWER SLIDE WITH SOCKET

(76) Inventor: Mark Jeffrey Lowe, 334 Greenacres Blvd., Bossier City, LA (US) 71111

( * ) Notice: Subject to any disclaimer, the term of this patent is extended or adjusted under 35 U.S.C. 154(b) by 149 days.

(21) Appl. No.: 10/964,109

(22) Filed: Oct. 13, 2004

(65) Prior Publication Data

US 2006/0076862 A1 Apr. 13, 2006

(51) Int. Cl.
*A47B 88/00* (2006.01)

(52) U.S. Cl. ..... 312/334.4; 312/334.5

(58) Field of Classification Search ..... 312/334.4, 312/334.6, 334.5, 334.7, 334.8, 334.12; 384/19
See application file for complete search history.

(56) References Cited

U.S. PATENT DOCUMENTS 3,104,142 A * 9/1963 Geren et al. ..... 312/333
3,139,313 A * 6/1964 Rule ..... 312/334.44
3,574,437 A * 4/1971 Stein et al. ..... 312/334.19
3,658,399 A * 4/1972 Vogt ..... 312/334.41
3,675,883 A 7/1972 Holmes et al.
3,697,140 A * 10/1972 Livingston ..... 384/19
3,750,993 A * 8/1973 Read ..... 248/298.1
4,176,890 A * 12/1979 Gorton ..... 312/334.41
4,244,546 A 1/1981 Mertes et al.
4,278,309 A 7/1981 Dreiling
D270,413 S 9/1983 Gutner et al.
4,501,453 A * 2/1985 Gutner et al. ..... 384/23
4,564,248 A 1/1986 Grass
4,863,288 A 9/1989 Houck
4,927,216 A * 5/1990 Boda ..... 312/334.12
5,039,181 A 8/1991 Lautenschlager
5,257,861 A 11/1993 Domenig
5,349,723 A 9/1994 Domenig
5,359,752 A 11/1994 Domenig
5,549,376 A 8/1996 Domenig
5,664,855 A * 9/1997 Lautenschlager et al. ..... 312/334.4
5,746,490 A 5/1998 Domenig
5,823,648 A 10/1998 Domenig
5,842,759 A * 12/1998 Ferrari et al. ..... 312/334.5
D442,077 S 5/2001 Crooks et al.
6,302,502 B1 * 10/2001 Larsen, Jr. ..... 312/334.4
6,324,473 B1 * 11/2001 Eschenbach ..... 701/215
6,367,900 B1 4/2002 Woemer
6,733,098 B1 * 5/2004 Branson ..... 312/352
7,090,320 B2 * 8/2006 Chen et al. ..... 312/334.5
2003/0160552 A1 * 8/2003 Bacho et al. ..... 312/334.5
2004/0104651 A1 * 6/2004 Kreft et al. ..... 312/334.5
2005/0264146 A1 * 12/2005 Fitz ..... 312/334.5
2006/0226748 A1 * 10/2006 Kinsel et al. ..... 312/334.7

* cited by examiner

*Primary Examiner*—Janet M. Wilkens
(74) *Attorney, Agent, or Firm*—Schultz & Associates, P.C.

(57) ABSTRACT

A self-closing drawer slide assembly for installation between a drawer and the interior of a cabinet is disclosed in conjunction with a compatible mounting socket for mounting the rear of the cabinet member to the rear wall of the cabinet. The socket telescopically accepts the declining rear portion of the cabinet member and is telescopically adjustable to suit a range of variations in the length of the drawer slide or the length of the cabinet. The socket also has a range of lateral adjustment which is transferable into lateral adjustment for the drawer slides assembly once installed.

11 Claims, 6 Drawing Sheets

STAY-CLOSED DRAWER SLIDE WITH SOCKET

CROSS REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to drawer slides for suspending drawers in a cabinet.

BACKGROUND OF THE INVENTION

Stay closed drawer slides have become more and more prevalent in cabinet applications. Most cabinets are used in kitchen and bathroom environments, although not exclusively so, and since there is quite often a great deal of human traffic in these areas the need existed for a drawer that would tend to stay closed. One can appreciate the fact that open drawers can pose a hazard to an unsuspecting passer-by and it has been known that some drawers of the non-stay closed type would somewhat spontaneously open on their own accord because of loading effects, misalignment or possibly other causes.

Stay closed drawer slides of the prior art are known using two members for the suspension of a drawer within a cabinet. For example, U.S. Pat. No. 4,564,248 (Grass) shows a two member drawer slide with portions of the drawer and cabinet members angled to promote a tendency for the slide assembly to stay in the closed position. In particular, the rear of the cabinet member has a declining angle for the flange that supports the roller on the drawer member. Similarly, in the front portion of the drawer member, there is an inclining angle imparted to the flange that rides on the cabinet member roller. The effect is that as the drawer member is moved from an open position to a closed position, and the angled areas in each member are reached simultaneously, the drawer member (and hence the drawer) is urged rearward through the effect of gravity acting to bias the drawer slide into rolling into the angled areas.

A similar design is shown in U.S. Pat. No. 4,863,288 (Houck) which also has portions of the drawer member and cabinet member angled to promote a stay close bias. The prior art drawer slides have cabinet members that are mounted directly to the sidewalls of the cabinet. This has been an effective approach in fitting out a cabinet with stay close drawer slides, however the installation of the assembly does require a degree of precision in fitting the cabinet member to the cabinet and the drawer member to the drawer. If a mistake is made in measuring the components, or in screwing the slides in place, then the assembly may have the drawer front land on the cabinet frame, or the drawer may extend outwardly from the front of the cabinet. As a result, the assembly process is done with great care which reduces the production efficiency when using the prior art drawer slides.

The observation has been made that efficient installation of stay close drawer slides in a production setting, such as a cabinet manufacturer, is a desirable objective that has not been fully achieved until now.

SUMMARY OF THE INVENTION

A new drawer slide assembly for suspending a drawer within a cabinet, comprises a stay close slide, employing a drawer member and a cabinet member, where the cabinet member is mounted into an adjustable socket that is fastened to the rear wall of the cabinet.

The socket for the present invention is further comprised of two components, a socket base and a socket receiver, where the socket receiver compatibly receives the rear portion of the cabinet member. The socket receiver is adjustably mounted in the socket base which allows the cabinet member to be adjusted laterally.

The socket receiver is constructed to accept the angled rear portion of the cabinet member, allowing the member to be retained in an orientation that facilitates installation of the slide into the socket and the socket onto the rear wall of the cabinet, all the while retaining the stay close function.

The combination of the socket and drawer slide of the present invention also provides for an improved method of installation. The depth of the socket receiver admits to the installation of a range of cabinet members of different lengths. This allows the socket of the present invention to be used in various applications without having to resort to a sized socket system for each. In addition, it corrects for any minor deviations or errors in allowing for the given length of a slide.

The socket receiver as adjustably installed within the socket base, also can automatically provide for lateral correction for a drawer slide installation.

These and other attributes and benefits of the present invention are discussed in more detail below.

DETAILED DESCRIPTION OF THE PREFERRED EMBODIMENTS

Drawer slides have steadily undergone an evolution from a time when they were nothing more than wooden guides that assisted in the opening and closing of a drawer. Consumer demands have resulted in drawer suspension systems that have improved capacity, that contain user-friendly features, provide for easy installation, while maintaining an economical position consistent with their increasing use in modern furniture products of many types.

A class of drawer slides developed in the 1990's that were given the name "Euro-slides" and these slides had a fairly distinctive design. Euro-slides are typified by having two members that telescopically move between an open position and a closed position. These members are lightweight components, typically manufactured from steel, and are formed as channels that interconnect with each other and which support rollers in between.

The movement of the Euro-slide is smoother than slides of early design, owing in part to the powder coatings that are commonly used for their finish, and also to the fact that their channels have flanges that are formed up to "capture" a roller body and cause the slide to move in a fairly defined and rigid pathway. This imparts a richness and feeling of quality to the slide products that was lacking in the previous designs.

The two-membered slide design has continued to evolve and certainly one feature that has become a very important consideration for those who design cabinets is the inclusion of a stay close function in the drawer slide selection. The most common way the stay close function is obtained is for the rear portion of the cabinet member to be angled downwardly, and for the forward portion of the top flange of the drawer member to be angled upwardly. When the two members are moved from an open position to a closed position, the drawer member, riding on its roller, reaches the rear angled portion of the cabinet member at approximately the same time the front portion of the top flange of the drawer member meets up with the roller mounted on the cabinet member. When this occurs, the drawer member remains in a substantially horizontal alignment while it is lowered in relation to the cabinet member.

The ramp-like effect of this movement is smooth, there is no abrupt transition, and it is completely initiated by gravity. Loadings in the drawer will assist in the effect although the weight of the drawer and associated hardware is typically sufficient to achieve the desired stay close effect. Reversing the process, i.e., opening the drawer, will cause the drawer member to ride back up into it former open orientation.

Variations are known with respect to the depth of the angle used to gain the effect, although for the purposes of the present invention, these variations may be selected to obtain the desired effect and do not represent limitations of any kind.

Figure 1:
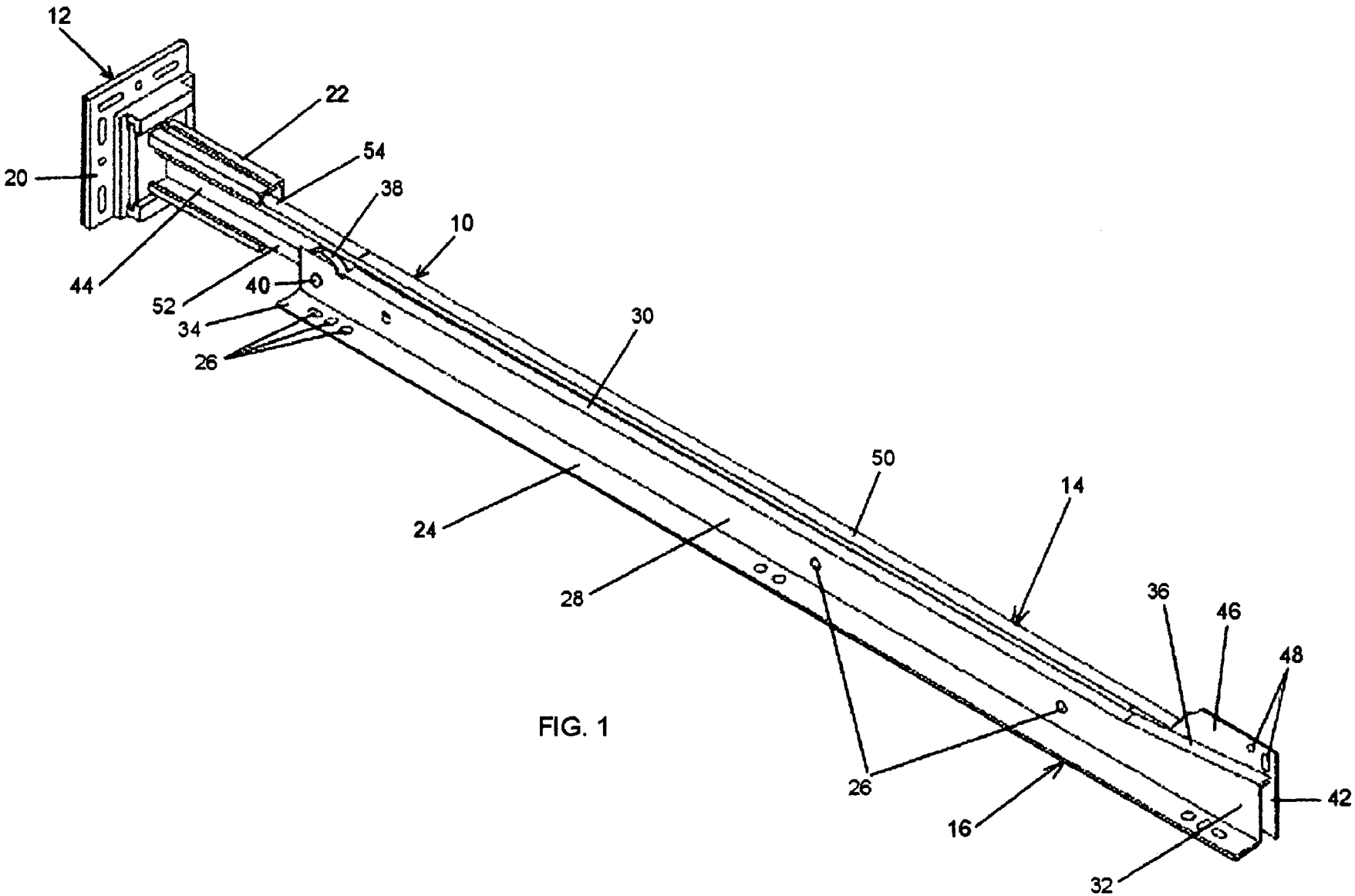
FIG. 1 shows a perspective view of a drawer slide and socket of the present invention in a closed position

With the foregoing in mind, a drawer slide assembly 10 of the present invention is shown in FIG. 1 in the closed position. This includes the socket 12, the cabinet member 14 and the drawer member 16. It is understood that the drawer slide assembly is shown for illustration purposes and that when installed, a pair of such slides are used on either side of a drawer to suspend the drawer within a carcass.

The socket 12 includes the socket base 20 and the socket receiver 22.

The drawer member 16 includes the drawer flange 24, drawer mounting holes 26, drawer member sidewall 28, drawer member top flange 30, drawer member front 32 and rear 34, the stay close flange 36, drawer member roller 38, and drawer member roller axle 40.

The cabinet member 14 includes the cabinet member front 42, cabinet member rear 44, cabinet member mount 46, cabinet member mounting holes 48, cabinet member top flange 50, cabinet member bottom flange 52, and the stay close portion 54.

Figures 2, 3:
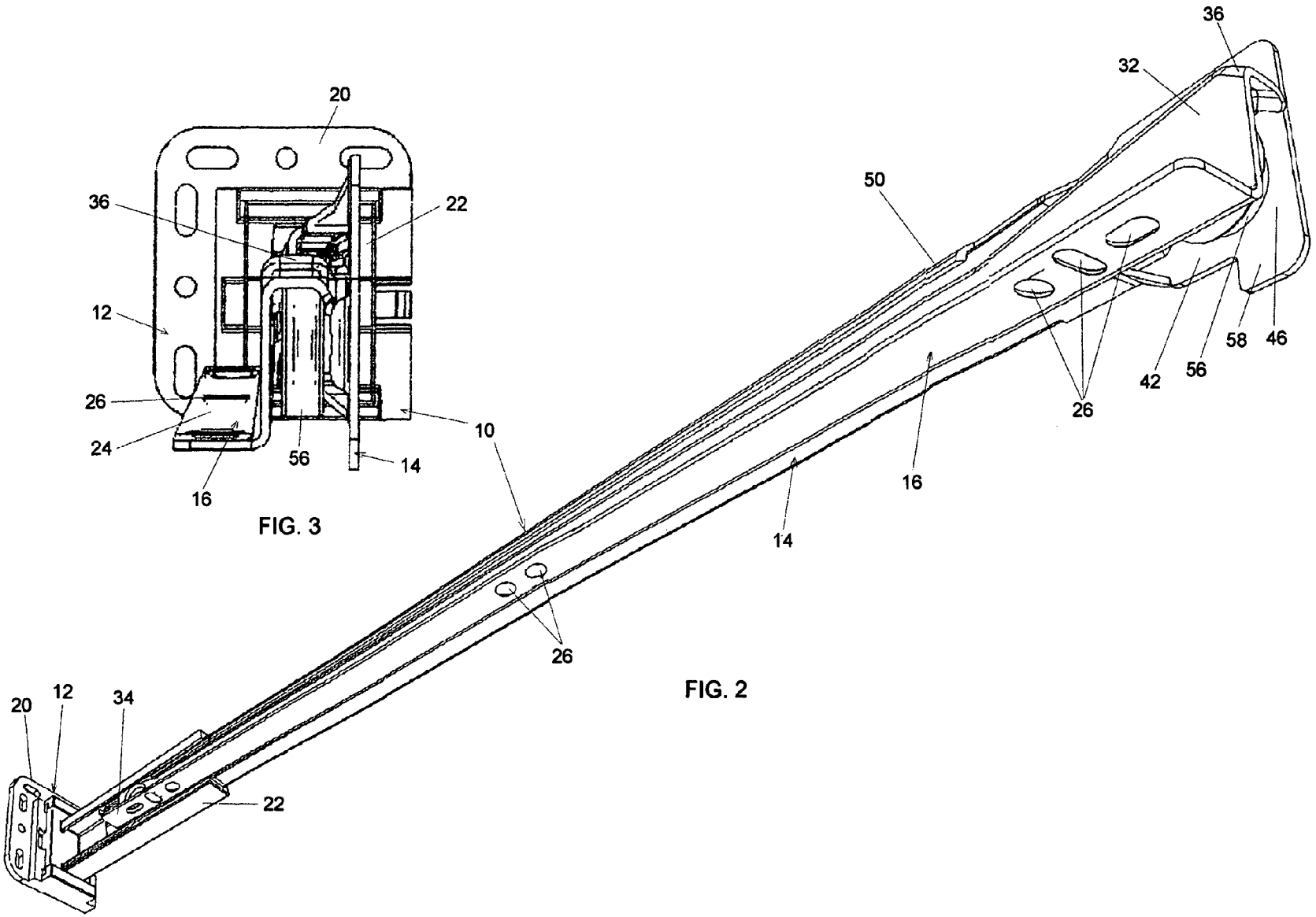
FIG. 2 shows another perspective view of a drawer slide and socket of the present invention from a position underneath the assembly.
FIG. 3 is an end view of the drawer slide and socket assembly of the present invention.

Turning to FIG. 2, the underside of the drawer slide assembly can be seen with cabinet member roller 56 and the cabinet member front rest 58. FIG. 3 is an end view showing many of the same features that were revealed in FIGS. 1 and 2.

Figure 4:
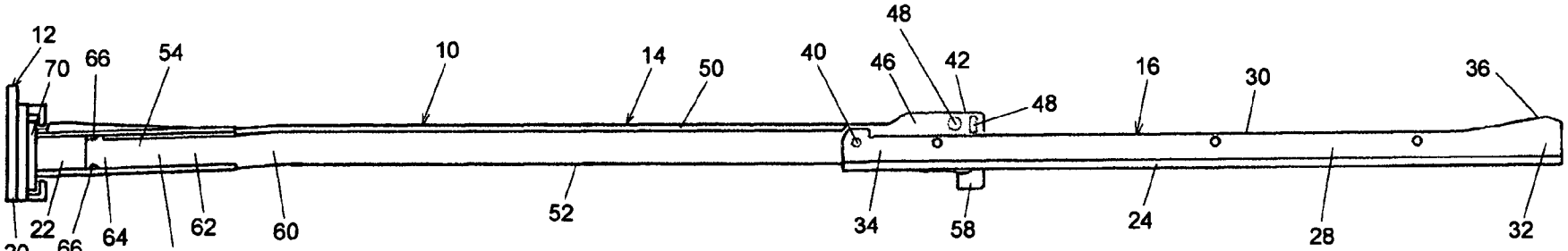
FIG. 4 discloses a side elevational view of a drawer slide and socket assembly of the present invention in the fully open position.

FIG. 4 shows the drawer slide assembly of the present invention in the fully extended, or open, position. Towards the rear of the cabinet member 14, an area is shown where the member is angled downwardly and is engaged with the socket receiver. The general vicinity where the angle commences is the stay close portion start 60, then at a general mid-point is the stay close portion intermediate 62, and towards the rear of the cabinet member is the stay close portion end 64. Also viewable is the socket receiver flange 70.

Figure 5:
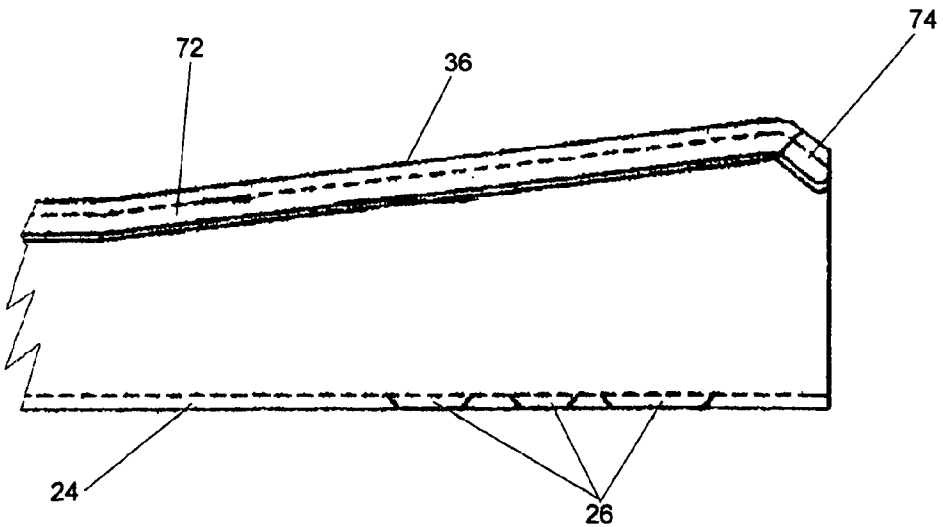
FIG. 5 shows a side elevational view of the front portion of the drawer member for a drawer slide and socket assembly of the present invention.

FIG. 5 discloses an enhanced view of the drawer member front 32 which includes the flange incline 72 and the flange stop 74.

Figure 6:
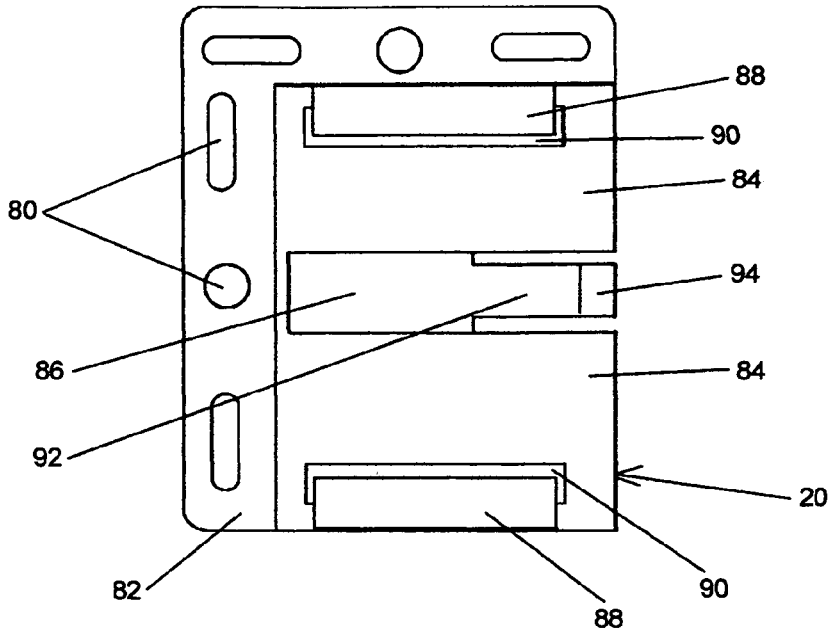
FIG. 6 is an end view of the socket base of the present invention.
Figure 7:
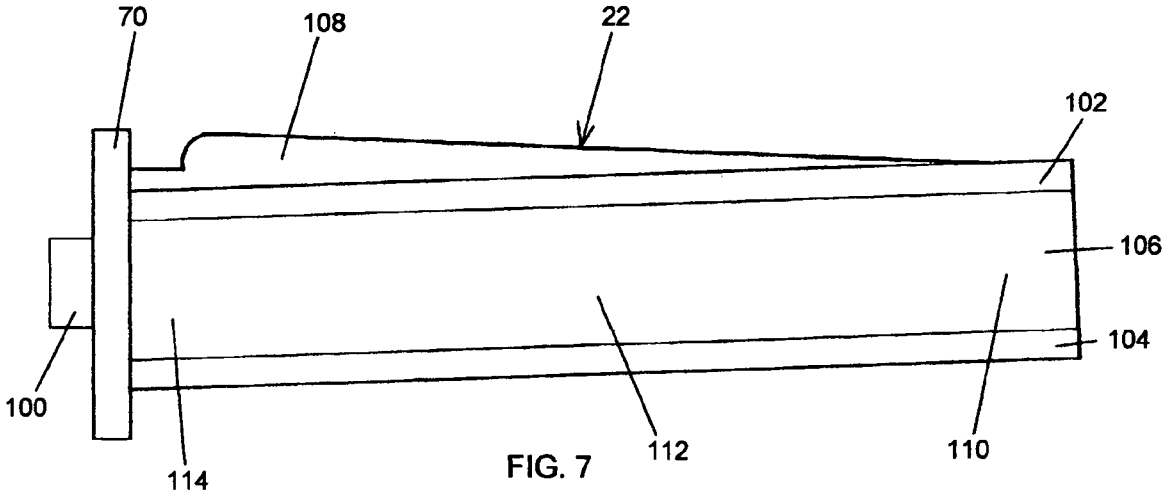
FIG. 7 is a side elevational view of the socket receiver of the present invention.
Figure 8:
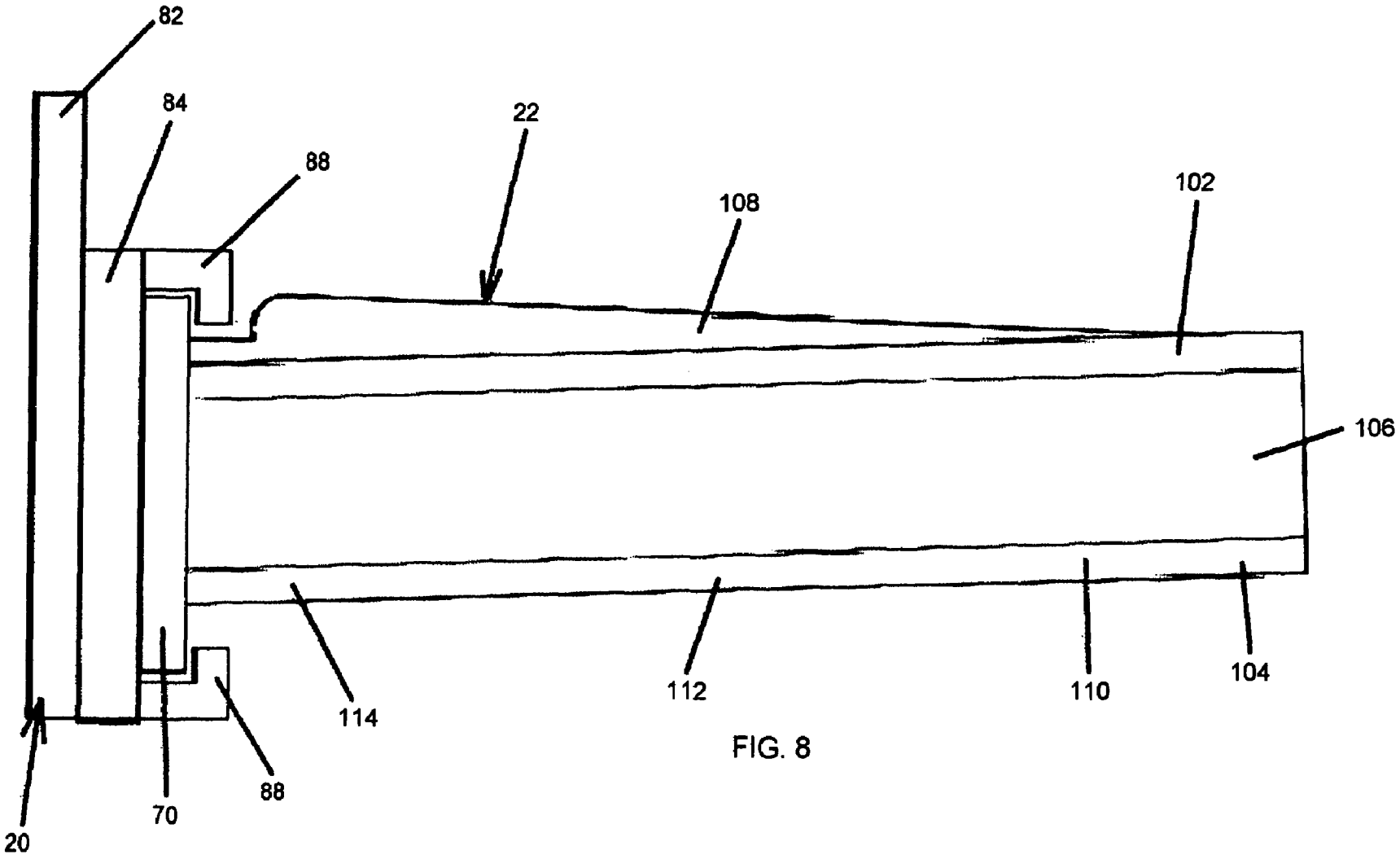
FIG. 8 is a side elevational view of a socket receiver of the present invention.

FIGS. 6, 7 and 8 show the components of the socket assembly, specifically the socket base 20 and the socket receiver 22. The socket base includes socket mounting holes 80, socket mounting flange 82, socket platform 84, socket recess 86, retaining flanges 88, retaining flange voids 90, the bottom retainer member 92 and the bottom retainer member end 94.

The socket receiver 22 includes the receiver rib 100, the upper guide 102, lower guide 104, receiver sidewall 106, the receiver brace 108 and the receiver brace end 120. Similar to the rear portion of the cabinet member, and in general correspondence with same, is the receiver stay close start 110, the receiver stay close intermediate 112, and the receiver stay close end 114.

Figure 9:
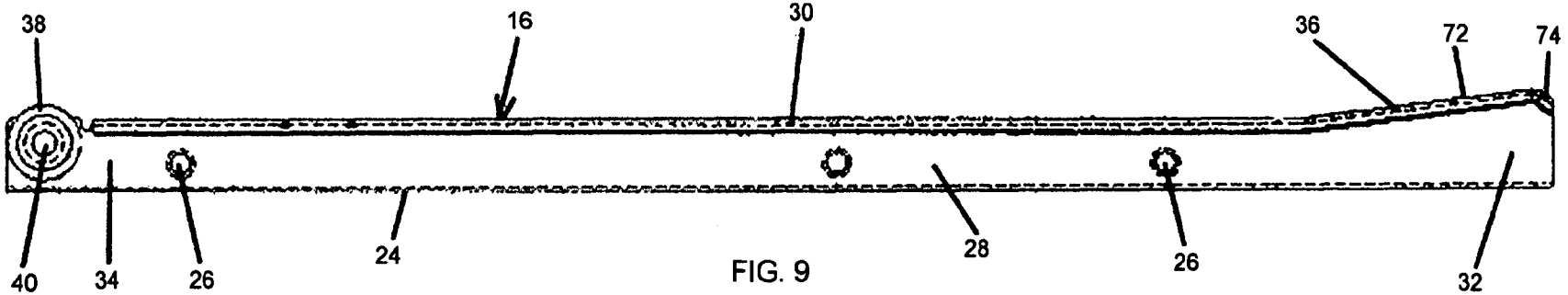
FIG. 9 is a side elevational view of a drawer member of the present invention.
Figure 10:
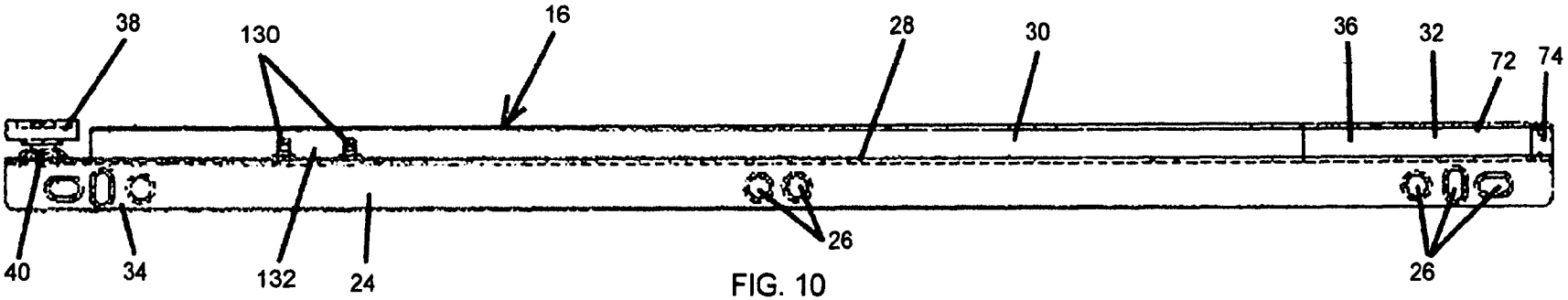
FIG. 10 is a side view of a drawer member of FIG. 9 as seen from the bottom.

FIGS. 9 and 10 show the drawer member of the present invention in more detail. In FIG. 10 in particular, the out stops 130 and the rest zone 132 can be seen.

The drawer slide assembly of the present invention allows a stay close feature to be included with a socket type installation. This is important since the ease of installation afforded by sockets reduces the manufacturing costs for cabinets. As in FIG. 1, the drawer slide assembly is oriented so the drawer member front and the cabinet member front are located near the opening in the cabinet where the drawer is located. The socket, and the rear portions of the cabinet member and when closed, the drawer member, are oriented towards the rear of the cabinet with the socket actually being fastened to the rear wall of the cabinet. In the chance that the particular cabinet construction does not have a rear wall, the socket may be fastened to a frame member.

The drawer member moves between the open and closed position, carrying the drawer body (not shown) on the drawer flange. In the open position, the drawer member is located at a slightly higher elevation as compared to the cabinet member than when the drawer member is in the closed position. As may be appreciated, this results from the travel of the drawer member into the stay close regions on both the rear of the cabinet member and on the front of the drawer member. This occurs simultaneously in the preferred embodiment, with the object of keeping the drawer body as level as practical during opening and closing. Thus the angles for the stay closed portions (start, intermediate and end) for each of the cabinet member and the drawer member stay close flange are essentially equal. The degree of angle for each may be varied, with the result that the effects of the stay close bias will be correspondingly greater or weaker.

The bias resulting from the angles employed, comes from the combined weight of the drawer, its contents, and the hardware. Since the drawer body weight is being transmitted to the drawer member roller and the stay close flange, then when the drawer reaches the "start" portion of the stay close areas the gravitational effect is to urge the drawer body to continue rolling to the end of its travel, to a fully closed position, without the application of any other force.

Prior art assemblies using sockets for installation are not adaptable to the traditional self close drawer slide design. In those applications the cabinet members continue without any angles to the rear. In the present invention, the socket assembly compatibly receives the cabinet member of a self close type, and retains lateral and length-wise adjustability.

The cabinet member of the present invention is inserted into the socket receiver. The length of the cabinet member (and the drawer slide assembly) can vary somewhat in length in the preferred embodiment owing to the length of the socket receiver. The cabinet member rear may engage the socket receiver for a small distance or may be sized to be fitted for the whole length of the socket receiver. Insertion is easily accomplished by aligning the cabinet member rear between the upper and lower guides in the socket receiver and pressing the member in place. The guides (and the whole socket assembly) are preferentially manufactured from a plastic resin and some elastic engagement occurs between the guides and the cabinet member.

The socket receiver is itself fitted into the socket base in a way where the socket receiver rib is allowed to ride within the socket base recess. The socket receiver flange is correspondingly retained by the retaining flanges which also have some elastic engagement. This elastic engagement is enhanced somewhat by the retaining flange voids that reduce the stiffness of the retaining flanges.

The socket receiver is allowed to travel laterally within a defined space in the socket base. Upon insertion of the socket receiver in the socket base, the socket receiver rib depressed the bottom retainer member and the bottom retainer member end, until the rib clears the end and the bottom retainer member returns to it normal alignment. The socket receiver then can traverse the lateral pathway defined by the recess and bounded by the bottom retainer member end on one side and the body of the socket base platform on the other. The actual amount of travel that is allowed is a matter of selection, however, the typically case does not require much, usually in the range of ¼" to ½". When the drawer slide assembly is installed in the socket, any variances in the width dimensions of the cabinet and/or the drawer body are automatically taken up by the socket which allows the cabinet member to follow the path of the drawer member. This is important with captive roller slides since their pathway is inflexible to a point and without the provision for some lateral adjustability there would be potential for doing damage to the drawer slide members and/or the cabinet and drawer.

In contrast to the methods for installing the stay close drawer slides of the prior art, the present invention allows for a quick and highly efficient fitting of the drawer slide assembly to the cabinet. The cabinet member front can be quickly aligned with the face frame or opening in the cabinet. The cabinet member front is positioned height-wise by means of the cabinet member front rest which sits onto the frame member of a cabinet and elevates the cabinet member to the proper desired height for installation. Using the mounting holes, the cabinet member is tacked in using screws, staples or any other competent fastener, and the rear portion of the cabinet member, in the socket, is located in the proximity of the desired located for mounting. Making sure the cabinet member is level, the socket is fastened to the rear wall of the cabinet by using screws, staples or other fasteners through the socket mounting holes and into the rear cabinet wall. The drawer member, being attached to the drawer, is inserted into the cabinet member and upon opening and closing the lateral position of the cabinet member is adjusted to suit the individual installation.

It may be apparent, however, the combined length of the cabinet member and socket are adjusted by adjusting the telescopic engagement of the two accordingly. Thus variances can be accommodated without the resort to seeking special sized slide components or by having to shim or rework the cabinet.

In those applications where the stay close feature is not required or desired, the socket assembly of the present invention may still be used. The same preferred cabinet member is necessary to compatibly engage the socket, however the drawer member may be shortened to a degree where it does not traverse into the rear portion of the cabinet member that has the stay closed architecture. The front of such a drawer member would also be modified to provide for non-stay close functionality as well. The advantage in such an application would come from the reduction of the number of component parts that may be needed for a production operation.

Other attributes may be considered as additional features for the preferred embodiment. The stopping function to halt the travel of the drawer and drawer slide assembly during opening may be accomplished by the placement of the out stops on the drawer member top flange in the pathway of the cabinet member roller. When the drawer member (and drawer) reaches the out stops, the roller will traverse the first stop and then will stop at the second which is larger than the first. Since the roller is captive within the Euro-style channel member, the size of the stop doesn't have to be too great to obstruct the passage of the roller beyond the rest zone located in between the out stops. The tendency of the roller is to stay in the rest zone, leaving the drawer member (and drawer) in the fully extended position during this time. This feature is essentially the reverse function as compared to the stay close, and could be viewed as a stay open.

To reverse the opening procedure it merely takes a slight amount of rearward pressure on the drawer member to urge the drawer member top flange over the first out stop and then towards the rear of the cabinet.

The cabinet member end stops can be used to stop the rear travel of the drawer member as it reaches the end of its travel. In this instance, it is the drawer member roller that contacts a stop feature that is located in the channel member. As viewed in the drawings (FIG. 4) the cabinet end stops 66 are formed up from adjacent flange material and are shaped to conform to the radius of the drawer member roller. Thus when the roller meets the cabinet end stops it will make contact across a substantial portion of the roller body.

The cabinet end stop is useful when the drawer member is comparatively sized the same length as the cabinet member. In some situations, such as the use of a non-stay close drawer slide, the drawer member will be shorter in length than the corresponding cabinet member. It is possible to use the drawer front in a situation such as this to act as an end stop by having the drawer front contact the frame around the drawer opening in which the drawer is suspended. There are some drawbacks to this since the drawer front is many times made from wood and repeated stopping action via this method can result in the cracking and/or fracture of the drawer front.

Preferentially the socket assembly is fabricated from plastic injectable resins. The particular selection of a resin is up to one skilled in the art. The sockets could be fabricated from metal, such as die cast or sintered metal, but the corresponding design would have to accommodate the characteristics of the metal used to ensure the appropriate amount of elastic deformation where needed.

The embodiment and variations discussed above are meant to be illustrative of the way the invention may be practiced and are not intended to restrict or limit the scope of the invention in any way.

The invention claimed is:

1. A self-closing drawer slide assembly for suspending a drawer within a cabinet comprising:

at least two drawer slides installable onto a drawer, where each of said drawer slides includes a rear declining portion for self-closing action and a front portion including a stay close flange;

a socket assembly associated with each of said drawer slides, where each socket assembly includes a socket base releasably and laterally connected to a socket receiver wherein the socket receiver is laterally adjustable with respect to the socket base, wherein the socket receiver is slideably and longitudinally connected to the rear declining portion and wherein each rear declining portion is longitudinally adjustable within the corresponding socket receiver; and, where the socket base is mountable onto the rear wall of the cabinet and is releasably coupled to the socket receiver with a flexible latch.

2. A self-closing drawer slide assembly as set forth in claim 1, where each of the at least two drawer slides includes a cabinet member front rest means for determining proper installation height for mounting each front portion of each said drawer slide assembly.

3. A self-closing drawer slide assembly as set forth in claim 1, where each of the at least two drawer slides further includes a drawer member top flange, having a first out stop and a second out stop, where the first out stop is larger than the second out stop, where the drawer member top flange supports a cabinet roller and where the second out stop prevents the passage of the cabinet roller and the cabinet roller tends to rest between the first out stop and the second out stop.

4. A cabinet comprising:

a front, two sides, and a rear wall;

at least one drawer;

at least two drawer slides mounted on each of said drawers, where the drawer slides include a rear declining portion for promoting self-closing action;

a socket assembly associated with each of said drawer slides, where each socket assembly includes a declining receiver longitudinally and slideably supporting the rear declining portion of each drawer slide and wherein each declining receiver is laterally and slideably supported by a socket base;

wherein each socket base is vertically and laterally adjustably mounted to the interior of the cabinet; and, wherein the declining receiver is laterally and slideably supported by the socket base by a pair of opposing support flanges and a releasable latch member affixed to the socket base.

5. A self-closing drawer slide assembly for suspending a drawer within a cabinet comprising:

at least two self-closing drawer slides for attachment to a drawer, where each of said drawer slides includes a rear declining portion for promoting a self-closing bias;

a socket assembly associated with each of said drawer slides where each socket assembly includes a receiver removably attached to a base; and, further where said receiver removably accepts and supports the rear declining portion of each drawer slide and where the receiver provides for a range of longitudinal travel of the rear declining portion of each drawer slide, wherein the receiver and the base are slideably engaged and allow for a range of lateral travel, and where the base is mountable on the rear wall of the cabinet and is releasably coupled to the socket receiver with a flexible latch.

6. A self-closing drawer slide assembly as set forth in claim 5, where each of the at least two self-closing drawer slides includes a cabinet member front rest means, attached at a front portion of each drawer slide, for height adjustment of the drawer during installation in the cabinet.

7. A self-closing drawer slide assembly for suspending a drawer within a cabinet comprising:

at least two self-closing drawer slides for attachment to a drawer, where each of said drawer slides includes a rear declining portion for promoting a self-closing bias;

a socket assembly associated with each of said drawer slides where each socket assembly includes a receiver and a base;

further where said receiver longitudinally and slideably accepts and retains the rear declining portion of a drawer slide, and the receiver and the base are slideably engaged for a range of lateral travel, and where the base is mountable on the rear wall of the cabinet and is releasably coupled to the receiver with a flexible latch; and, where the drawer slide and the socket assembly are longitudinally and slideably adjustable for accommodation of variations in the length of the cabinet.

8. A method for installing a self-closing drawer slide assembly onto a drawer and in a cabinet, the steps of which comprise:

releaseably attaching a socket receiver to a socket base by depressing a bottom retainer member end and laterally inserting a socket receiver flange under a set of socket base retaining flanges until a socket receiver rib engages the bottom retainer member end;

fitting a cabinet member from a self-closing drawer slide assembly into the socket receiver;

aligning a cabinet member front with a drawer opening in the cabinet;

positioning the cabinet member front to the appropriate height for installation in the drawer opening in the cabinet using a cabinet member front rest attached to the self-closing drawer slide assembly;

securing the cabinet member front to the cabinet;

leveling the cabinet member within the cabinet;

fastening the socket base to the rear wall of the cabinet;

inserting the drawer, with drawer members installed, into the cabinet and engaging the drawer members with the corresponding cabinet members;

laterally adjusting the location of the socket receiver within the socket base to properly align the cabinet member with the drawer member by opening and closing the drawer.

9. A self-closing drawer slide assembly for suspending a drawer within a cabinet comprising:

at least two drawer slides installable onto the drawer;

a socket assembly associated with each of said drawer slides, where each socket assembly includes a socket base releasably and laterally connected to a socket receiver;

where the socket receiver is laterally adjustable with respect to the socket base;

where each socket receiver is slideably connected to a corresponding rear declining portion;

where each rear declining portion is longitudinally adjustable within the corresponding socket receiver and where each socket base is mountable onto the interior of a cabinet; and, where each socket receiver is laterally and slidably supported by the corresponding socket base by a pair of opposing support flanges and a releasable latch member affixed to each socket base.

10. A self-closing drawer slide assembly as set forth in claim 9, where the socket base is mountable on the rear wall of the cabinet and is releasably coupled to the socket receiver.

11. A self-closing drawer slide assembly as set forth in claim 9, where each of the at least two drawer slides includes a cabinet member front rest means for determining proper installation height for mounting each said front portion of each said drawer slide assembly.

* * * * *